United States Patent [19]

Lacombe

[11] 4,030,263

[45] June 21, 1977

[54] PROTECTIVE CAPPING CHANNEL FOR GLASS SEALED UNIT

[75] Inventor: Gaetan Y. Lacombe, Duvernay, Canada

[73] Assignee: D.C. Glass Ltd., Ville D'Anjou, Canada

[22] Filed: Nov. 11, 1975

[21] Appl. No.: 630,771

[52] U.S. Cl. ..... 52/616; 428/34; 428/100; 428/122; 428/358; 428/542

[51] Int. Cl.² ..... E04B 2/28; E06B 3/24

[58] Field of Search ..... 428/358, 34, 99, 100, 428/122; 52/304, 400, 616, 619, 171; 24/255 R, 259 FS, 259 PW

[56] References Cited

UNITED STATES PATENTS

| | | | |
|---|---|---|---|
| 1,008,029 | 11/1911 | Gorman | 428/100 |
| 1,988,964 | 1/1935 | Barrows | 428/34 |
| 3,442,059 | 5/1969 | Kessler | 52/616 |
| 3,533,896 | 10/1970 | Hartig | 428/138 |
| 3,566,542 | 3/1971 | Gillen | 52/400 |

FOREIGN PATENTS OR APPLICATIONS

| | | | |
|---|---|---|---|
| 833,267 | 2/1970 | Canada | |
| 953,159 | 8/1974 | Canada | |
| 42-19120 | 9/1967 | Japan | 428/34 |
| 898,981 | 6/1962 | United Kingdom | 428/34 |
| 1,227,943 | 4/1971 | United Kingdom | 428/34 |

*Primary Examiner*—George F. Lesmes
*Assistant Examiner*—William R. Dixon, Jr.
*Attorney, Agent, or Firm*—Roland L. Morneau

[57] ABSTRACT

A capping channel for a glass sealed unit adapted to be surrounded by a layer of polysulphide sealant. The channel comprises a rigid U-shaped member made of a thermally non-conducting polyvinyl chloride compatible with the polysulphide sealant. The member comprises ribs projecting from the inner surface of its base and adapted to penetrate in the sealant for increasing the retention of the channel to the unit. The ribs are set by pairs to form a V-shape and are provided with a lip extending from the free edge of the ribs, each lip of the pair being directed towards each other.

10 Claims, 4 Drawing Figures

PROTECTIVE CAPPING CHANNEL FOR GLASS SEALED UNIT

The present invention is directed to a protective capping channel for glass sealed unit and more particularly to such a channel adapted to prevent thermal shocks.

Thermal shocks are known in the art of glass windows and doors. They are essentially produced, in thermo panes, when one glass pane is exposed to a hot temperature and the other to a cold temperature, while a thermal conducting material touches both panes. The phenomenon usually happens during the winter in cold countries when the inside of the building is kept warm. For example, if the weather outside is about −20° F, the outer pane has about the same temperature. In this condition, if the room temperature is at 70° F, the temperature of the inner pane is at about 45° F. If a metallic capping channel covers the edges of the sealed unit and is in contact with both panes, this channel with conduct the heat or the absence of heat from one pane to the other. Under the conditions of the example given above, the surface of the inner pane will start to show a small crack originating near the metallic channel and extending toward the center of the pane. This is caused by stresses in the glass where the gradient of temperature is too sharp.

Protective capping channels made of metal are well known to be commonly used. These channels transfer the cold weather from the outside to the inside of the building. It is one of the reasons frost can be observed on the inner edge of windows and doors during some cold days of the winter. These metal channels touch or are very close to the glass panes and cause the sharp thermal gradient along the edge of the glass.

One of the solutions to this problem has been to dispense with capping channel. Either the sealed unit is immerged in a glazing material or a tape is used to cover the edge and make the unit suitable to be handled and transported.

It is one object of the present invention to overcome some of the problems created by the prior art. According to the invention, a thermally non-conducting material is contemplated to surround the glass sealed unit. It is another object of the invention to provide a capping channel made of a material compatible with the sealant material of the unit so that no chemical reaction will take place. It is a further object of the invention to provide means for reliably retaining the channel over the sealed unit so that under normal condition, the channel will not come off. It is also imperative that the material of the capping used will stand the normal variation of temperature and will resist breakage to normal and even rough handling.

According to the invention, the new protective capping channel for glass sealed unit comprises a U-shaped member made of a thermally non-conducting material and adhesion means disposed over the inner surface of the base of said member for causing the retention of said channel to said unit. The invention is particularly directed to the embodiment wherein the inner surface of the base is provided with ribs adapted to penetrate in the sealant inside the said sealed unit.

The invention will now be described in greater details by referring to the annexed drawings in which.

Figure 1:
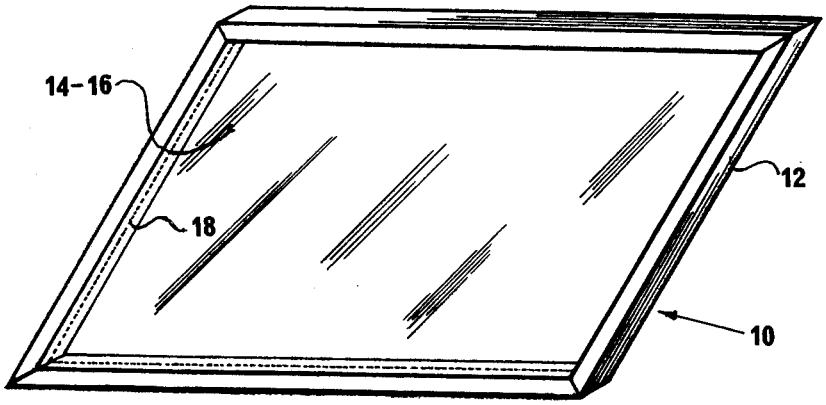
FIG. 1 is a perspective view of a glass unit.

FIG. 1 illustrates a finished glass sealed unit 10 around which a protective capping channel 12 is mounted on each of the four sides of the unit 10 to hold a pair of panes of glass 14 and 16 together and spaced by the spacer 18.

Figure 2:
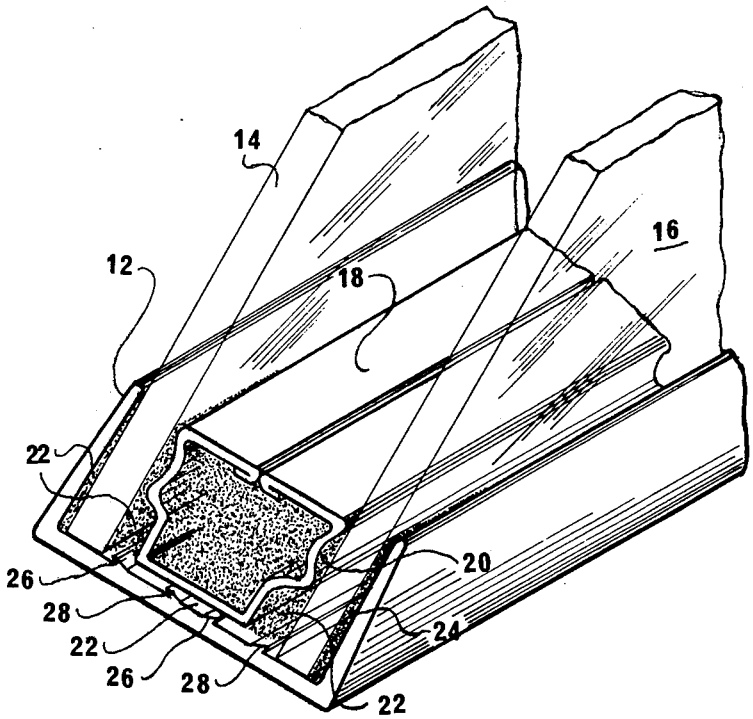
FIG. 2 is a perspective view of the edge of a sealed glass unit seen at a cross-section thereof and showing an embodiment of a capping member according to the invention.

FIG. 2 shows a cross-section taken along one edge of the sealed unit shown in FIG. 1. The spacer 18 is sandwiched by the edge of the glass panes 14 and 16. The spacer may be of the type disclosed in copending application Ser. No. 630,772 filed simultaneously by the same applicant and entitled: "Spacer For Glass Sealed Unit and InterLock Member Therefor". A butyl sealant 20 is inserted in a groove portion of the spacer adjacent its inner surface, that is, the surface adjacent the air space between the panes 14 and 16. A polysulphide sealant 22 is disposed around the outer surface of the spacer 18 and the adjacent portions of its sides. The capping 12 having substantially a U-shaped cross-section surrounds the outer edge of the panes 14 and 16.

The two sides of the channel are slightly bent inwardly to form a small pressure on the panes 14 and 16. The small tilt of the sides allows a small quantity of the surplus of polysulphide to flow in the cavities 24 between each pane and the sides of the channel 12.

One of the object of the invention is to eliminate the thermal conductivity from one pane to the other. One embodiment consists of making the channel with an appropriate plastic material. A rigid polyvinyl chloride (PVC) is particularly suited for this purpose. However, such PVC must be compatible with the sealant and particularly with the polysulphide. The compatibility consists in that no chemical reaction or dissolving takes place between the sealant and the plastic material of the channel 12. The compatibility can be overcome by lining the inner surface of the channel with a suitable primer. However, it is preferable to make a selection of the suitable plastic which will not react.

A plastic material which is compatible with the polysulphide is known by the trade-mark Geon 8700A sold by B. F. Goodrich Co. Some other plastic materials may be made compatible with polysulphide by coating the inner surface of the channel with a primer such as the one known by the trade-mark Plastilok sold by the Tremco Co.

The arragement as explained above enables to prevent thermal shocks in glass sealed units.

Another problem which is solved according to an additional characteristic of the present invention consists in the retention of the channel 12 over the edges of the panes 14 and 16. When the sealed units are not too roughly handled, the channel 12 satisfactorily adheres on the edges of the unit. The additional characteristic which increases the retention power is provided by short ribs 26 and 28 projecting along the inner surface of the base of the U-shaped channel 12. These ribs project inside the polysulphide and provide additional contact surfaces on which to grip itself. These ribs may project perpendicularly from the base of the channel but the retention power is increased when these ribs are inclined relative to the base of the channel. When these ribs are in an inclined position, they form a rigid wall which prevents the flow of the polysulphide in the direction caused by the removal of the capping channel 12.

Figure 4:
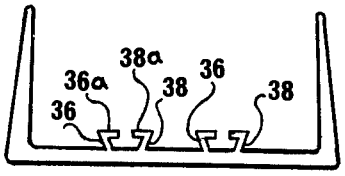
FIGS. 3 and 4 are two different embodiments of the capping channel for the sealed unit.
Figure 3:
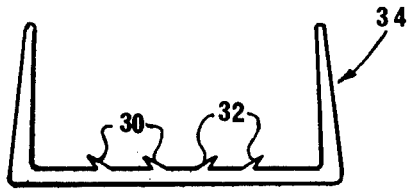

Various embodiments for the arrangement of these ribs are foreseen, three of which are illustrated in FIGS. 2, 3 and 4. In FIG. 2, the ribs 26 and 28 are set by pairs in a V-shaped arrangement. At least two of these ribs are disposed so as to leave a space between the base of the channel 12 and the bottom of the spacer 18 so as to allow the polysulphide to set therebetween and cause a positive retention in that region of the unit. It should be understood that if the bottom of the spacer 18 would lie against the base of the channel 12, a considerable amount of retention power would be lost. The ribs give a positive assurance that this spacing would be maintained for the flow of the polysulphide.

Another embodiment of the capping channel is illustrated in FIG. 3 wherein ribs 30 are angularly oriented in the same direction on one of the channel 34 while the ribs 32 are angularly oriented in the other direction. In this arrangement, the ribs are spaced so that at least two of them will support the bottom of the spacer.

A third embodiment of the channel is illustrated in FIG. 4 wherein the ribs 36 and 38 are disposed by pairs such as illustrated in FIG. 2, but wherein the upper edge of the ribs are provided with inwardly directed lips **36*a* and 38*b*. These lips are intended to increase the retention power of the channel on the sealed unit because a cavity is formed by each pair of lips and ribs to grip the polysulphide which flows therethrough. Furthermore, the lips 36*a* and 38*a*** form a better support for the bottom of the spacer which is adapted to rest on them.

A large majority of the capping channels have a maximum width of between 0.75 and 1 inch and a maximum height between 0.4 and 0.5 inch. The thickness of the base of the channel may vary according to the length of the channel and the use expected, but resides substantially around 0.04 to 0.05 inch. The ribs are inclined relative to the base at an angle between 30° and 60° and preferably around 45°. The height of these ribs is less than 0.1 inch and preferably varies between 0.03 and 0.04 inch.

From an aesthetic point of view, it has been found that the most suitable color for the capping channels is black or dark grey because any amount of polysulphide which spreads out cannot be noticed as much as if the channel would be of a light color. Furthermore, these sealed units are handled by people who do not necessarily have cleaned hands or gloves and a dark colored channel makes any spot less obvious.

As stated above, a rigid PVC is preferred and the rigidity is very useful to ascertain the retention of the channel around the sealed unit.

Furthermore, the retention could be obtained by a glue spread over the inside surface of the channel which would allow the adherence between the plastic material and and the polysulphide. Plastic glues sold by the Tremco Co. or the P.R.C. Co. are suitable for this purpose.

In the above description, it has been stated that the polysulphide flows into various parts of the sealed unit but this sealant hardens within an hour and sticks solidly to the PVC plastic of the channel.

PVC plastic material and in particular the Geon 8700A is a hard and rigid plastic which does not scratch easily, can be manipulated with the hands because it is smooth and does not chip easily. Compared to the known metal channels, it does not cut the hands when manipulated. Furthermore, although it is a rigid plastic, it is still slightly flexible compared to a metal capping and therefore can be mounted over the sealed unit with greater facility.

Although only three embodiments of the present invention have been described, it should be clear for a person skilled in the art that many modifications may be contemplated without departing from the scope of the following claims.

What I claim is:

1. A protective capping channel for a glass sealed unit of the type having a rigid spacer sealed with a polysulphide sealant between the edges of two panes of glass, the said channel comprising a thermally non-conducting rigid plastic U-shaped member, the said member having a flat base and two integral lateral walls slightly tapering towards each other, the distance between the said walls adapted to cover the edges of panes of glass spaced by a spacer, the said base having short thin ribs integrally projecting on the inner surface of the base of said channel, the said ribs projecting angularly relative tothe said surface of the base and having a lip projecting sidewise from the free end of the said ribs, whereby the said lip of the ribs are adapted to abut against the spacer and to maintain the said spacer at a distance from the base of the channel and to allow retention of the channel to the sealant.

2. A capping channel as recited in claim 1, wherein the height of the ribs is less than 0.1 inch.

3. A capping channel as recited in claim 2, wherein the height of the ribs is approximately between 0.03 and 0.04 inch.

4. A capping channel as recited in claim 3, wherein the ribs are set by pairs to form a V-shape.

5. A capping channel as recited in claim 3, wherein the ribs are set by pairs to form a V-shape, a lip extending from the free edge of the ribs of each pair, each lip of the pair being directed towards each other.

6. In a glass sealed unit comprising a pair of panes of glass arranged in spaced relationship to form an air space therebetween, a rigid spacer disposed between the marginal edges of the panes of glass, a protective capping channel disposed over the marginal edges of the panes of glass to maintain the said panes in adjacent relationship with the spacer, and a polysulphide sealant spread between the panes and the spacer and between the panes and the capping channel, the improvement consisting in the said channel being a thermally non-conducting, rigid, plastic U-shaped member, the said member having a flat base and two intergral lateral walls slightly tapering towards each other, the said base having short, thin ribs integrally projecting on the inner surface of the base of said channel, the said ribs projecting angularly relative to the said surface of the base and having a lip projecting sidewise from the free end of the said ribs, whereby the said lips abut against the spacer to maintain the latter at a distance from the base, the said distance allowing a layer of sealant between the spacer and the base of said channel, the said ribs and lips being immersed in the sealant to assure a positive retention of the channel to the sealant.

7. A sealed unit having a capping channel as recited in claim 6, wherein the ribs are set by pairs to form a V-shape.

8. A sealed unit having a capping channel as recited in claim 7, wherein the height of the ribs is approximately between 0.03 and 0.04 inch.

9. A sealed unit having a capping channel as recited in claim 6, wherein the ribs are set by pairs to form a V-shape, a lip extending from the free edge of the ribs of each pair, each lip of the pair being directed towards each other.

10. A sealed unit having a capping channel as recited in claim 6, wherein the height of the ribs is less than 0.1 inch.

* * * * *